US005088247A

United States Patent [19]

Young

[11] Patent Number: 5,088,247

[45] Date of Patent: Feb. 18, 1992

[54] RETURNED STAIR TREAD HAVING MOISTURE COMPENSATED JOINT

[76] Inventor: Robert H. Young, Route #3, Box 177, Beaver Dam, Ky. 42320

[21] Appl. No.: 536,318

[22] Filed: Jun. 11, 1990

[51] Int. Cl.[5] ..... E04F 11/00

[52] U.S. Cl. ..... 52/182; 52/179; 52/716; 52/829

[58] Field of Search ..... 52/182–188, 52/179, 191, 716–718, 829

[56] References Cited

U.S. PATENT DOCUMENTS 4,730,425 3/1988 Young ..... 52/182

*Primary Examiner*—Richard E. Chilcot, Jr.
*Attorney, Agent, or Firm*—Maurice L. Miller, Jr.

[57] ABSTRACT

A returned tread for use on an open stairway or open portion of a stair way constructed of wood and a return nosing joined on at least one side edge of the tread so as to form an exposed joint on a forward end portion of the assembly. The tread and nosing are fastened or secured together only along a forward end portion which contains at least a portion of the exposed joint. The remainder of the nosing and tread are slidable relative to one another and are joined on a rear end portion by means of an expansion joint. In one embodiment, the expansion joint includes an oval shaped biscuit glued and disposed in a slot formed in a nosing facing edge of the tread which biscuit projects into an elongated slot formed in the nosing for permitting the biscuit to slide along the elongated slot as the tread expands and contracts. In the second embodiment, the biscuit is replaced by a peg glued into a blind hole in the nosing which projects into an elongated slot formed in a nosing facing edge portion of the tread for permitting the peg to slide along the elongated slot as the tread expands and contracts relative to the nosing. The expansion slot of the expansion joint may be formed in either the nosing facing edge of the tread or in the tread opposing edge of the nosing.

11 Claims, 2 Drawing Sheets

RETURNED STAIR TREAD HAVING MOISTURE COMPENSATED JOINT

BACKGROUND OF THE INVENTION

This invention relates generally to returned stair treads and more specifically to wooden returned stair treads containing exposed joints on forward end portions thereof that will not pull apart, gap or otherwise become deformed due to changes in ambient temperature and humidity or changes in the moisture content of the wood.

Returned stair treads, generally speaking, have long been known and used in the prior art. Typically, such prior art stair treads include a tread constructed of wood with a return nosing affixed to a side edge of the former so as to form an exposed joint along a forward edge portion of the assembly. Such prior art nosings are usually glued to the side of the stair treads along the entire length thereof and, in addition, are nailed to their respective treads at several different positions therealong.

A major problem that has been encountered with such prior art construction is that the exposed joint tends to open or become gapped or otherwise deformed in an unsightly manner when the returned stair tread is exposed to ambient temperature and humidity conditions beyond those encountered when the nosing was originally affixed to the stair tread. Such conditions are usually at their worst during late Summer when returned treads are stored or otherwise disposed in non-air conditioned surroundings such as a warehouse or building under construction.

I have previously developed a returned stair tread having a moisture compensated joint which overcomes these prior art difficulties. See my U.S. Pat. No. 4,730,425 issued Mar. 15, 1988. That patent discloses both a shaped joint and mitered joint for a returned stair tread wherein, in one embodiment, only the forward region of the joint itself is glued, the remainder of the nosing being slidable along the side of its corresponding stair tread due to tongue and groove connection between them. In the alternative, my said patent teaches that the nosing may be secured to the side of the tread by means of a single nail or other suitable mechanical fastener driven through the nosing and into the tread at or very near the rear end of the shaped or mitered joint, while the remainder of the nosing is slidable along the tread due to tongue and groove connection between them. Also my said patent teaches that the shaped or mitered joint may be secured by both glue applied between the nosing and tread in the region of the joint and also nailed or otherwise mechanically fastened with a single nail or fastener as previously described, with the remaining portion of the nosing and tread being slidable relative to one another by means of tongue and groove construction therebetween.

Since the issuance of that patent, I have discovered two additional forms of moisture compensated construction for returned stair treads which will likewise substantially reduce or eliminate unsightly gapping of a shaped or mitered joint on the forward end portion of the nosing and tread. These additional types of construction now permit a range of choices in overcoming the unsightly gapping problem of the exposed joint that has been encountered in returned stair treads of the prior art due to variations in temperature and humidity and in the moisture content of the wooden tread. Moreover, these new types of construction eliminate the need for tongue and groove interconnection between the nosing and tread.

SUMMARY OF THE INVENTION

It is an object of the present invention to provide an improved wood returned tread for use on an open stairway or an open portion of a stairway which contains an exposed joint on a forward side edge portion that will not pull apart or otherwise become deformed as a result of expansion and contraction of the tread such as occurs with ambient temperature and humidity changes and with changes in moisture content in the wood.

Briefly, in accordance with my invention, there is provided a returned tread for use on an open portion of a stairway which includes a stair tread constructed of wood and having at least one side edge fashioned to fit flush against an opposing surface of a return nosing to form an exposed joint between the tread and nosing along a forward end portion of the tread and nosing. Also included is a return nosing fitting flush against the side edge of the tread. The tread and nosing are slidably connected to one another by an expansion joint, which expansion joint is spaced rearwardly from the exposed joint. Means is also provided for securing the nosing to the tread only in a region containing the exposed joint which is spaced forwardly from the expansion joint to prevent gapping or other deformation of the exposed joint as the tread expands and contracts in width.

These and other objects, features and advantages of the present invention will become apparent to those skilled in the art from the following detailed description and attached drawings upon which, by way of examples, only the preferred embodiments of the invention are explained and illustrated.

DESCRIPTION OF THE PREFERRED EMBODIMENTS

Figure 1:
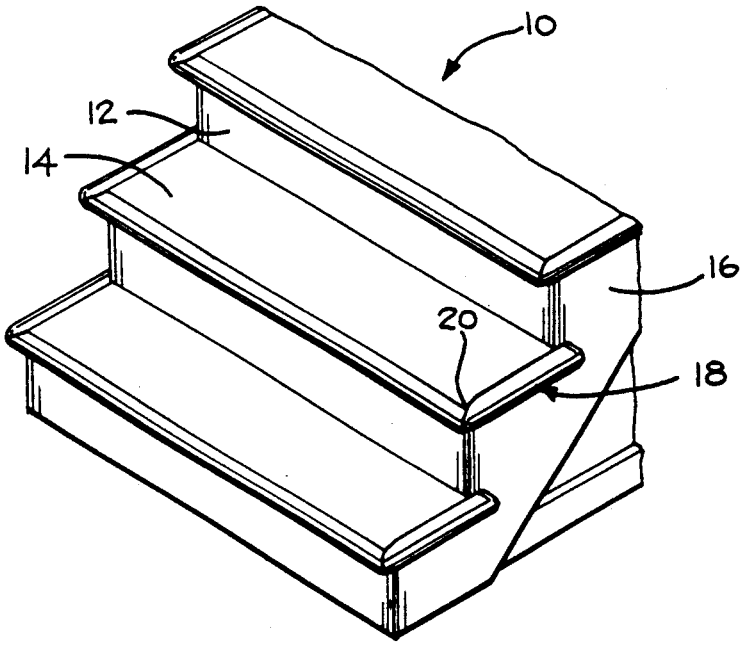
FIG. 1 shows a perspective view of a portion of an open stairway having return nosings connected to side edges of various stair treads to form exposed joints of the shaped type, thus illustrating one preferred embodiment of my invention.

Referring now to FIG. 1 of the drawings, there is shown in one preferred embodiment of my invention, an open portion of a stairway 10 having a series of risers 12, wooden stair treads 14 and stringers 16 on opposite sides thereof, only the stringer on the near side being shown. A forward edge portion of each of the treads 14 rests upon a different one of the risers 12, while side edge portions of each of the treads 14 rest upon horizontal ledges of the stringers 16. A return nosing 18 is connected to each side edge of each of the treads 14 which lie in the open portion of the stairway 10. In the present example, the return nosings 18 and their corresponding treads 14 are joined together to form a rounded or shaped joint 20 on the forward end portions thereof. The rear end portions of the nosings 18 extend rearwardly beyond their corresponding risers 12 along and flush against the stringers 16 for short distances. FIG. 1 shows only the conventional portions of the returned stair treads of my invention as they would appear on an open stairway in a fully assembled state.

Figure 2:
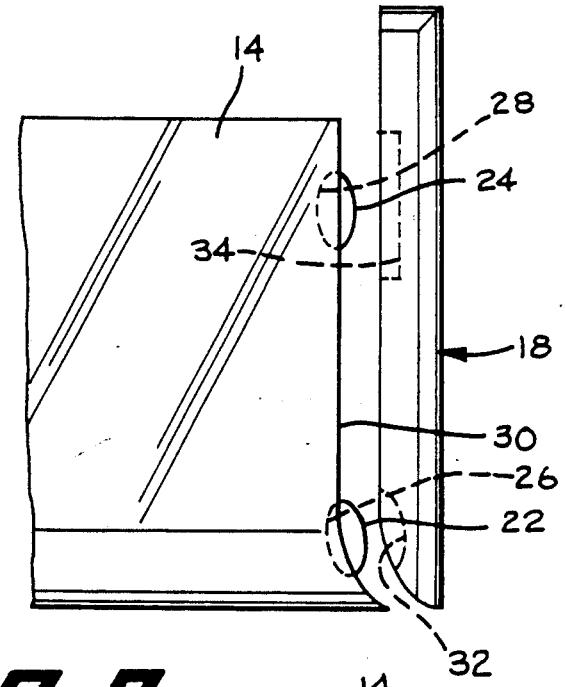
FIG. 2 shows a plan view of an open side edge portion of one of the stair treads of FIG. 1 and its corresponding return nosing exploded therefrom.
Figure 3:
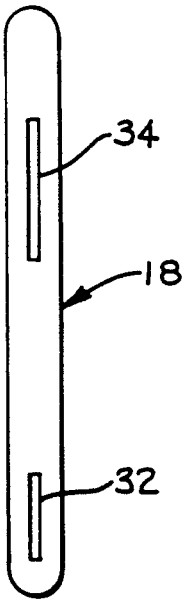
FIG. 3 shows an edge view of the return nosing of FIG. 2 rotated ninety degrees from its position as shown in the latter figure to illustrate a pair of slots therein.
Figure 4:
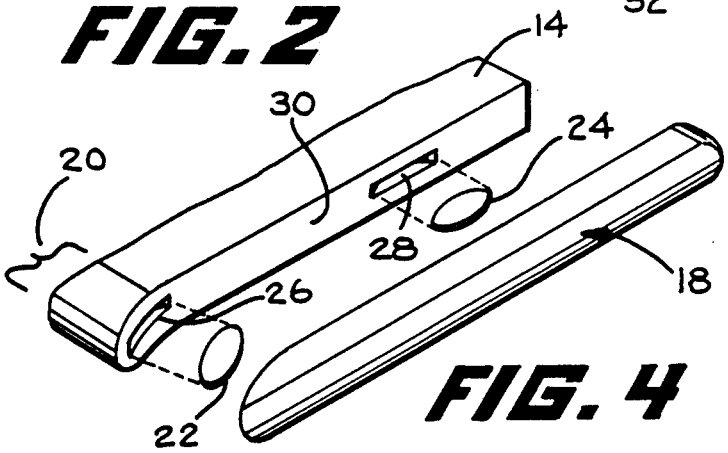
FIG. 4 shows a perspective view of a fragment of the stair tread and return nosing of FIG. 2 further illustrating the construction of and interconnection between the two components.

Referring now to FIGS. 2–4, the novel features of one of the wooden stair treads 14 and its corresponding return nosing 18 of the stairway 10 of FIG. 1 is shown. A pair of flat, oval shaped biscuits 22 and 24, constructed of wood, plywood or other suitable material, are provided. A pair of blind slots 26 and 28 are formed in an outer edge of the tread 14 in which the biscuits 22 and 24 are inserted and secured by glue so as to project outwardly beyond the outer surface 30 of the tread 14 (See particularly FIG. 2). A slot 32 is formed in a forward end portion of the nosing 18 in the region of the shaped joint 20. The slot 28 is formed near the rear end of the tread 14. The slot 32 is formed in the tread opposing edge of the nosing 18 so as to register with the slot 26 in the tread and confines the projecting portion of the biscuit 22 therein when the tread 14 and nosing 18 are joined. The biscuit 22 will ultimately be glued into both of the slots 26 and 32 when the tread 14 and nosing 18 are joined.

An expansion slot 34 is formed in the nosing 18 so as to receive the projecting portion of the biscuit 24 therein when the tread 14 and nosing 18 are joined. The slot 34 is relatively longer than the biscuit 24 and slot 28 and is positioned so as to extend well beyond both the forward and rear ends of the biscuit 24 and slot 28.

Now when the tread 14 and nosing 18 are joined with the biscuit 22 glued in both of the slots 26 and 32, the portion of the biscuit 24 which projects into a central portion of the slot 34 will be free to slide forward and rearwardly therein as the tread 14 expands and contracts rearwardly and forwardly in the direction of the length of the nosing 18 as a result of ambient temperature and humidity changes and as a result of moisture content changes in the wood. In the meantime, the exposed joint 20 will remain unchanged since the tread 14 and nosing 18 are glued together and to the biscuit 22 in this region.

The joint 20 will not become gapped or otherwise deformed due to temperature and humidity changes or moisture change in the wood because of the glue in this relatively short length of the forward end portions of the tread 14 and nosing 18 since the substantial remaining lengths of those two elements are free to slide against one another due to the fact that the biscuit 24 is free to move in and along the slot 34 in both the forward and rearward directions. The length of the slot 34 should be great enough to insure that the biscuit 24 will not travel to either end of the slot 34 and jam up against the end of the latter as the result of any reasonable foreseeable maximum expansion or contraction of the tread 14, considering all temperature, humidity and moisture conditions to which the assembly might reasonably be exposed. It is also permissible to secure the nosing 18 to the tread 14 with one or more finish nails or other suitable mechanical fasteners driven in the region of the exposed joint, the most rearward located one of which should not be more than about 3 inches from the forward edge of the joint 20. Otherwise, the length of the joint 20 thus secured will be so long that differences in expansion between the tread 14 and nosing 18 along their secured portions might become appreciable and result in gapping and unsightly deformation of the exposed joint 20. It will be appreciated that the positions of the biscuit slot 28 and expansion slot 34 can be reversed if desired so that the slot 28 would then be in the tread opposing surface of the nosing 18 and the expansion slot would then be in the nosing opposing surface 30 of the tread 14.

Referring now to FIGS. 5–8, there is shown in another preferred embodiment of my invention, an open stairway 40 including wooden stair treads 42, risers 44, a stringer 46 and return nosings 48 adjoined to side edges of all of the treads which are located on an open portion of the stairway 40. In the present example, an exposed joint 50 is formed between forward end portions of adjoining pairs of the treads 42 and nosings 48 which is of the well known mitered type.

Figure 5:
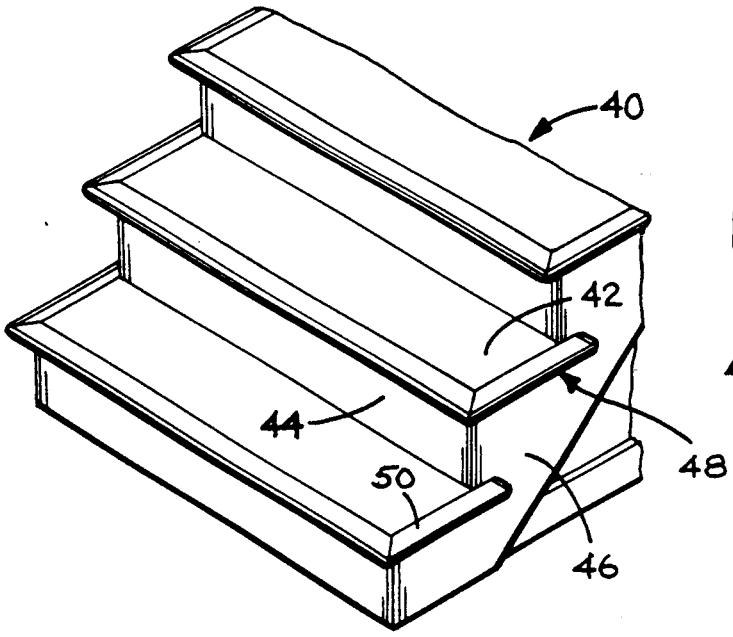
FIG. 5 shows a perspective view of a portion of an open stairway having return nosings connected to side edges of various stair treads to form exposed joints of the mitered type, thus illustrating another preferred embodiment of my invention.
Figure 6:
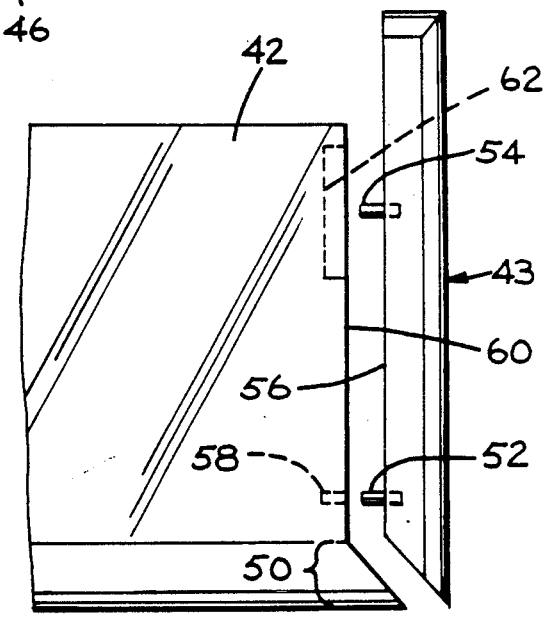
FIG. 6 shows a plan view of an open side portion of one of the stair treads of FIG. 5 and its corresponding return nosing exploded therefrom.
Figure 7:
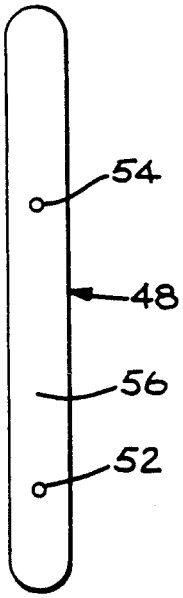
FIG. 7 shows an edge view of the return nosing of FIG. 6 rotated ninety degrees from its position as shown in the latter figure.
Figure 8:
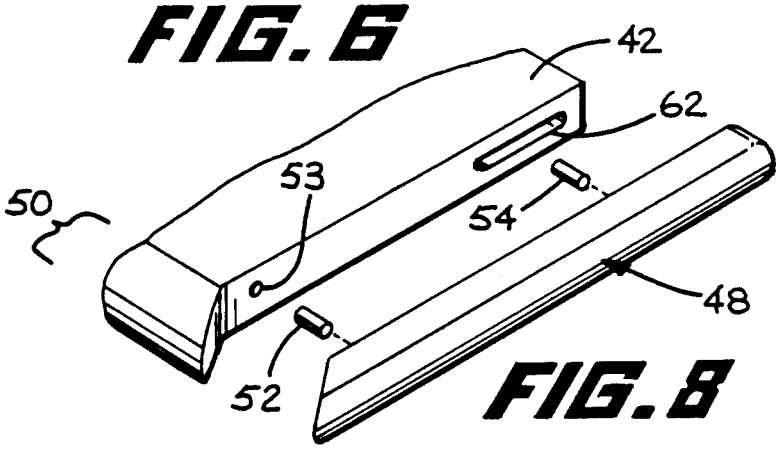
FIG. 8 shows a perspective view of a fragment of the stair tread and return nosing of FIG. 6 further illustrating the construction of and interconnection between the two components.

In accordance with FIGS. 6–8 which illustrate the structure and interconnection between one of the several adjoining pairs of treads 42 and nosings 48 of FIG. 5, a pair of spaced apart, cylindrically shaped wooden pegs 52 and 54 project out of two blind holes drilled in a tread opposing surface 56 of the nosing 48. The peg 52 is located just slightly rearward of the mitered joint 50, not more than about 3 inches from the forward end of joint 50 when assembled and projects into a blind hole 58 formed in a nosing opposing surface 60 of the tread 42. The peg 52 is also secured in the blind hole 58 by means of glue. The tapered surfaces of the joint 50 between the tread 42 and nosing 48 may also be glued together if desired.

The peg 54 projects into a central portion of an elongated rectangularly shaped expansion slot 62 formed in the outer edge 60 of the tread 42 near the rear end thereof. The peg 54 should form a relatively secure friction fit against the sidewalls of the slot 62, yet should be movable therealong as the tread 42 and nosing 48 move relative to one another during expansion and contraction of the wood as a result of changes in temperature, humidity and moisture content of the wood. The end walls of the slot 62 should be sufficient distance away from the peg 54 when the tread 42 and nosing 48 are joined so that the peg 54 will not come in contact with and bind up against either of the sidewalls under the most extreme expansion or contraction of the tread 42 that can reasonably be anticipated.

It will be appreciated that, instead of gluing the peg 54 into a hole in the nosing 48 so as to project into the expansion slot 62 located in an outer edge portion of the tread 42, the positions of the peg 54 and expansion slot 62 could be reversed. Also, a nail or other suitable mechanical fastener could be driven through a forward end portion of the nosing 48 and into the surface 60 of the tread 42 as a substitute for the peg 52 and blind hole 58.

Figure 9:
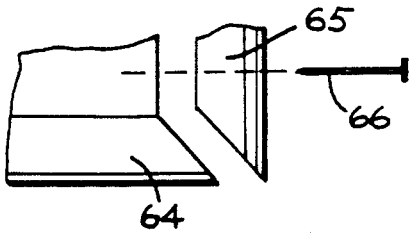
FIG. 9 shows a plan view of a fragment of a stair tread and nosing exploded from one another wherein the exposed joint between the aforesaid elements is rigidly secured by means of a suitable mechanical fastener.

Referring now to FIG. 9, there is shown a conventional exposed joint of the mitered type between a tread 64 and a nosing 65, both elements being of the same types as shown in FIG. 5 at 42 and 48, respectively, except that, in this case, the exposed joint is secured by means of a mechanical fastener 66 such as a finishing nail or wood screw rather than by means of a biscuit or peg as shown in the previous examples. In the alternative, the exposed joint may be glued or secured by a combination of glue and one or more mechanical fasteners, none of which extends more than about 3 inches from the front edge of the joint. An expansion joint, not shown, is then formed between the tread 64 and nosing 65 on a rear end portion thereof which may be of the biscuit and slot type as shown in FIGS. 2–5 or of the peg and slot type as shown in FIGS. 6–8. Accordingly, the exposed joint may be rigidly secured in any suitable manner provided that an expansion joint is formed between the tread and nosing on a rear end portion thereof. The term "expansion joint" as used throughout this patent does not include tongue and groove type construction such as that shown in my U.S. Pat. No. 4,730,425 issued Mar. 15, 1988.

Although the present invention has been shown and described with respect to specific details of certain preferred embodiments thereof, it is not intended that such details limit the scope of this invention otherwise than as specifically set forth in the following claims.

I claim:

1. A returned tread for use on an open portion of a stairway comprising a stair tread constructed of wood and having at least one side edge fashioned to fit flush against an opposing surface of a return nosing to form an exposed joint between said tread and nosing along a forward end portion of said tread and nosing, a return nosing fitting flush against said side edge, said tread and nosing being slidably connected to one another by an expansion joint, said expansion joint being spaced rearwardly from said exposed joint, and means for securing said nosing to said tread only in a region containing said exposed joint which is spaced forwardly from said expansion joint to prevent gapping or other deformation of said exposed joint as said tread expands and contracts in width.

2. The return tread of claim 1 wherein said securing means comprises a first wood biscuit disposed and glued within a pair of opposing slots formed in a forward end portion of said tread and nosing in a region at least partially containing said exposed joint.

3. The returned tread of claim 1 wherein said expansion joint comprises a slot containing a wood biscuit secured thereon and projecting out of said slot into an elongated expansion slot for permitting said biscuit to slide along said expansion slot as said tread expands and contracts relative to said nosing.

4. The returned tread of claim 1 wherein said expansion joint comprises a blind hole containing a peg secured therein and projecting out of said blind hole and into an elongated expansion slot for permitting said peg to slide along said expansion slot as said tread expands and contracts relative to said nosing.

5. The returned tread of claim 1 wherein said securing means comprises a peg disposed and glued in a pair of aligned blind holes formed in opposing side edges of said tread and nosing.

6. The returned tread of claim 3 wherein said biscuit containing slot is formed in a nosing opposing edge portion of said tread and said elongated expansion slot is formed in a tread opposing surface portion of said nosing.

7. The returned tread of claim 4 wherein said peg containing blind hole is formed in a tread opposing surface portion of said nosing and an expansion slot is formed in a nosing opposing surface portion of said tread.

8. The returned tread of claim 1 wherein said securing means is located within about three inches from the forward edge of said exposed joint.

9. The returned tread of claim 1 wherein said securing means comprises at least one mechanical fastener.

10. The returned tread of claim 9 wherein said mechanical fastener is selected from the group consisting of finishing nails and wood screws.

11. The returned tread of claim 1 wherein said securing means comprises a first wood biscuit disposed and glued within a pair of opposing slots formed in a forward end portion of said tread and nosing in a region at least partially containing said exposed joint, said expansion joint comprising a slot containing a second wood biscuit secured therein and projecting out of said slot into an elongated expansion slot for permitting said second wood biscuit to slide along said expansion slot as said tread expands and contracts relative to said nosing.

* * * * *